US008075944B2

(12) United States Patent
Mishima

(10) Patent No.: US 8,075,944 B2
(45) Date of Patent: Dec. 13, 2011

(54) FILM FORMING METHOD AND PRODUCING METHOD FOR ELECTRON SOURCE SUBSTRATE

(75) Inventor: Seiji Mishima, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 995 days.

(21) Appl. No.: 11/354,811

(22) Filed: Feb. 16, 2006

(65) Prior Publication Data

US 2006/0216409 A1 Sep. 28, 2006

(30) Foreign Application Priority Data

Mar. 28, 2005 (JP) ..... 2005-090663

(51) Int. Cl.
*B05D 5/12* (2006.01)

(52) U.S. Cl. ..... 427/77

(58) Field of Classification Search ..... 427/77
See application file for complete search history.

(56) References Cited

U.S. PATENT DOCUMENTS

| | | | | |
|---|---|---|---|---|
| 6,210,245 | B1 | 4/2001 | Sando et al. | 445/6 |
| 6,220,912 | B1 | 4/2001 | Shigeoka et al. | 445/24 |
| 6,579,139 | B1 * | 6/2003 | Mishima et al. | 445/24 |
| 6,660,332 | B2 | 12/2003 | Kawase et al. | 427/266 |
| 6,667,795 | B2 * | 12/2003 | Shigemura | 349/187 |
| 6,815,001 | B1 | 11/2004 | Mishima et al. | 427/8 |
| 7,182,815 | B2 | 2/2007 | Katagami et al. | 118/665 |
| 7,246,878 | B2 * | 7/2007 | Ogawa et al. | 347/40 |
| 2001/0024227 | A1 * | 9/2001 | Sekiya | 347/101 |
| 2002/0067400 | A1 | 6/2002 | Kawase et al. | 347/101 |
| 2006/0109415 | A1 * | 5/2006 | Ueda | 349/187 |
| 2006/0146379 | A1 | 7/2006 | Katagami et al. | 358/505 |

FOREIGN PATENT DOCUMENTS

| | | | |
|---|---|---|---|
| CN | 1358626 | A | 7/2002 |
| EP | 0 936 652 | A1 | 8/1999 |
| EP | 0936652 | * | 8/1999 |
| EP | 1 225 472 | A2 | 7/2002 |
| EP | 1225472 | * | 7/2002 |
| JP | 8-171850 | | 7/1996 |
| JP | 11-044811 | A | 2/1999 |
| JP | 2000-251665 | | 9/2000 |
| JP | 2002-273868 | | 9/2002 |

(Continued)

OTHER PUBLICATIONS

Chinese Office Action dated Nov. 30, 2007, regarding Application No. 2006100716746.

*Primary Examiner* — Brian K Talbot
(74) *Attorney, Agent, or Firm* — Fitzpatrick, Cella, Harper & Scinto

(57) ABSTRACT

In case of forming films in plural positions with an ink jet head having plural nozzles, to provide a method of efficiently correcting an aberration in the liquid droplet applying position resulting for example from a distortion of a substrate, thereby producing an electron source with a high production yield. Positions of device electrodes 2, 3 on the electron source substrate 1 are detected by fetching in advance a surface image of the substrate 1, then a position of an electroconductive film 4 is calculated as a liquid droplet applying position, and an inclination angle θ of the ink jet head 11 is so regulated that a pitch of the nozzles 12 matches a pitch d of the obtained liquid droplet applying positions.

3 Claims, 12 Drawing Sheets

FOREIGN PATENT DOCUMENTS

| | | | |
|---|---|---|---|
| JP | 2003-265997 | A | 9/2003 |
| JP | 2004-141758 | A | 5/2004 |
| JP | 2004-255335 | A | 9/2004 |
| JP | 2004-347694 | A | 12/2004 |
| KR | 1999-0072696 | | 9/1999 |
| KR | 10-2004-0072811 | | 8/2004 |

* cited by examiner

FILM FORMING METHOD AND PRODUCING METHOD FOR ELECTRON SOURCE SUBSTRATE

BACKGROUND OF THE INVENTION

1. Field of the Invention

The present invention relates to a film forming method suitable for forming a conductive film constituting a component of an electron emitting device etc., a method for forming such conductive film, and a producing method for an electron source substrate utilizing the same.

2. Related Background Art

The present applicant has proposed, as an easy and inexpensive producing method for a surface conduction electron emitting device, a method of applying a metal-containing solution in a liquid droplet state onto a substrate by an ink jet equipment thereby forming a pair of element electrodes and a conductive film positioned therebetween (see following document 1). Also the present applicant has proposed, applying the above-mentioned method, a producing method for an electron source substrate including plural electron emitting devices arranged in a matrix on a same substrate (see following document 2).

FIG. 10 shows an example of a producing process for an electron emitting device by an ink jet equipment, wherein shown are a substrate 1, device electrodes 2, 3, a conductive film 4, an electron emitting portion 8, an ink jet nozzle 12, and a liquid droplet 13. At first device electrodes 2, 3 are formed on a substrate 1 (FIG. 10A). Then a metal-containing solution is applied as a liquid droplet 13, from a nozzle 12 of an ink jet equipment, between the device electrodes 2 and 3 (FIG. 10B). Then the film of the metal-containing solution is calcined to form a conductive film 4 (FIG. 10C), which is subjected to an energizing process to form an electron emitting portion 8. Further, there is a proposal of a technique that, in a manufacturing of a color filter for use in an image display apparatus, corresponding to an interval between adjacent color filters, an ink jet head having a plurality of nozzles is inclined in applying a filter material therefrom (See following document 3).

Document 1: Japanese Patent Application Laid-Open No. H08-171850

Document 2: Japanese Patent Application Laid-Open No. 2000-251665 (corresponding to EP 936652A)

Document 3: Japanese Patent Application Laid-Open No. 2002-273868 (corresponding to EP 1225472A)

In the method described in the Patent Reference 2, an applying position of the liquid droplet is regulated by a relative displacement of the ink jet head with respect to the substrate, thereby avoiding a loss in the production yield. However, when the liquid droplets are simultaneously applied in plural positions utilizing an ink jet head constituted of a linear array of plural nozzles for the purpose of shortening a tact time, such method is unable to avoid a loss in the production yield in case the substrate is distorted in shape from a design value.

SUMMARY OF THE INVENTION

An object of the present invention is to provide, in case of locally forming films in plural positions with an ink jet head having plural nozzles, a method of efficiently correcting an aberration in the liquid droplet applying position resulting for example from a distortion of a substrate, thereby forming films precisely and efficiently. The present invention is also provide a producing method for an electron source substrate utilizing such method.

The present invention in a first aspect thereof provides a method of forming films in plural positions of a substrate by locally providing the plural positions of the substrate with liquid droplets containing a film material by an ink jet head having a linear array of plural nozzles, the method including:

a step of detecting positional information of the plural positions on the substrate;

a step of calculating plural positional information for applying the liquid droplets based on the positional information detected in the detecting step; and a step of rotating the ink jet head about a normal line to the substrate according to the plural liquid droplet applying positions and applying liquid droplets onto the surface.

In a second aspect, the present invention provides a producing method for an electron source substrate formed by providing a substrate with plural electron emitting devices each having a pair of device electrodes and an electroconductive film having an electron-emitting area and extending between the device electrodes, and by connecting the electron emitting devices in a matrix wiring, wherein the electroconductive film is formed by the film forming method according to the first aspect.

In a third aspect, the present invention provides a producing method for an electron source substrate, including:

a step of preparing a substrate provided with plural device electrodes arranged in a matrix pattern, and plural linear wirings connecting a part of the plural device electrodes, and detecting positional information of at least a part of the device electrodes among the plural device electrodes on the substrate; and a step of positioning an ink jet head having a linear array of plural nozzles in an opposed relationship to the substrate and applying liquid droplets from the plural nozzles so as to be in contact with the device electrodes;

wherein the liquid droplet applying step includes a first liquid droplet applying step of applying the liquid droplets in a state where a longitudinal direction of the wiring and a direction of the linear arrangement of the nozzles define a first angle based on the detected positional information, and a second liquid droplet applying step of applying the liquid droplets in a state where the longitudinal direction of the wiring and the direction of the linear arrangement of the nozzles define a second angle different from the first angle.

DETAILED DESCRIPTION OF THE PREFERRED EMBODIMENTS

In the following, the present invention will be explained in a case of forming a conductive film in an electron emitting device constituting an electron source substrate.

Figure 11A:
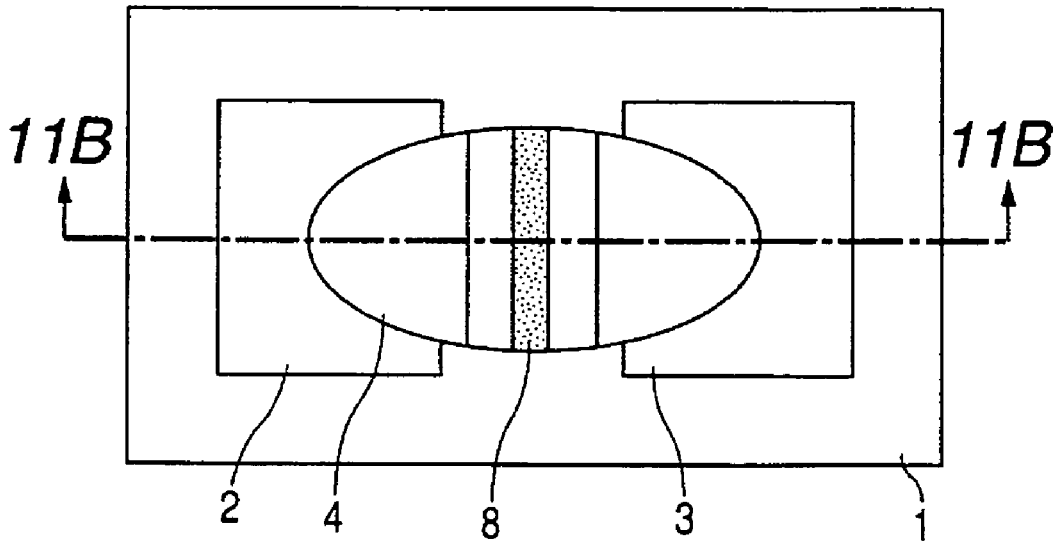
FIGS. 11A and 11B are schematic views showing a configuration of an electron emitting device constituting the electron source substrate of the present invention.
Figure 11B:
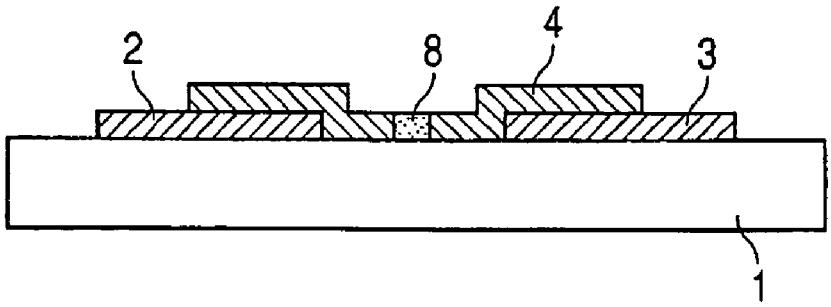
Figure 12:
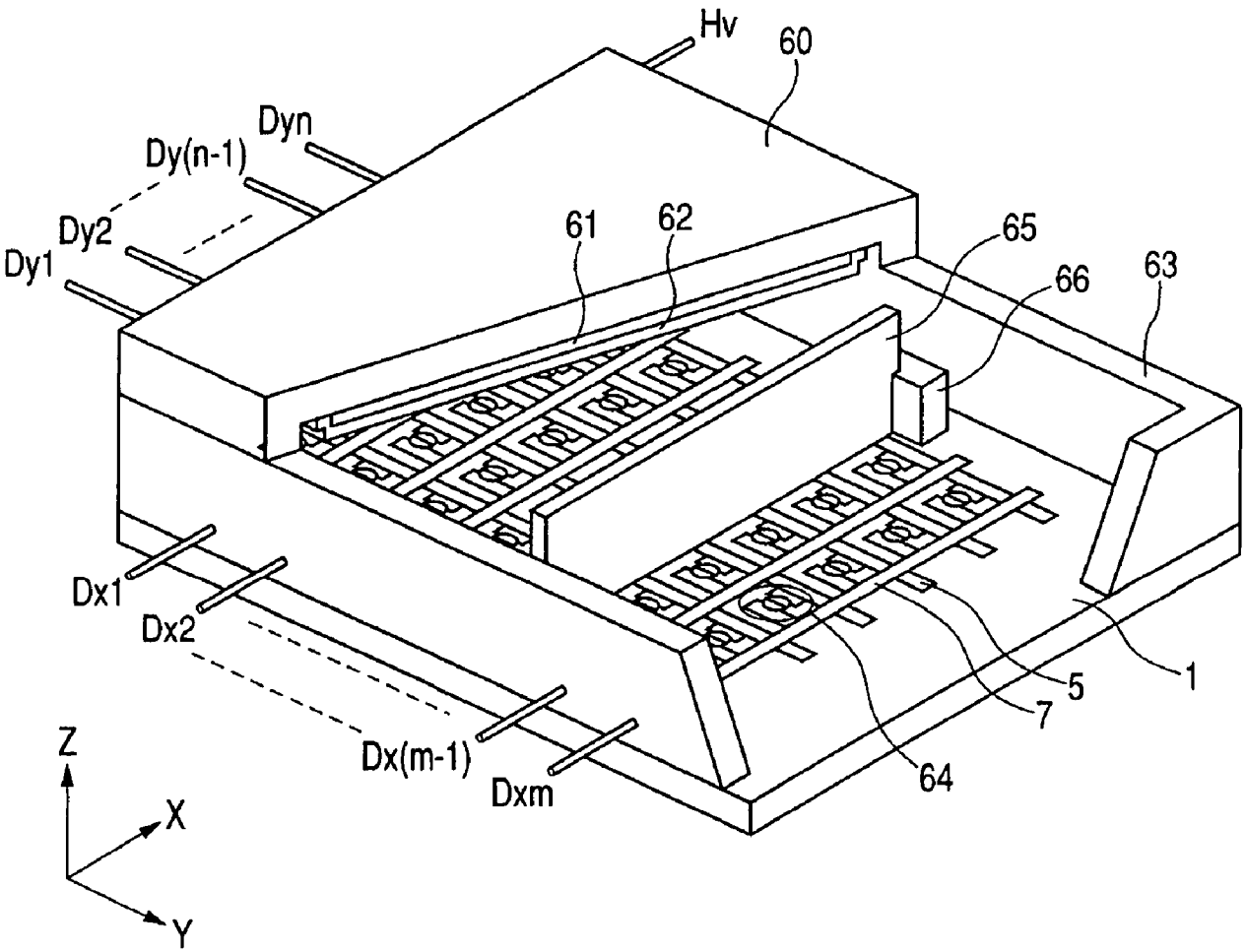
FIG. 12 is a perspective view showing a display panel constructed with the electron source substrate of the present invention.

FIGS. 11A and 11B are respectively a plan view and a cross-sectional view along a line A-A in FIG. 11A, schematically showing a basic structure of a surface conduction electron-emitting device in a configuration constituting an electron source substrate produced according to the present invention. In FIGS. 11A and 11B, there are shown a substrate 1, device electrodes 2 and 3, an electroconductive film 4, and an electron emitting area 8. A display panel constructed with such electron-emitting device is shown in FIG. 12, in which shown are an electron source substrate 1 of the present invention, a lower wiring 5, an upper wiring 7, a face plate 60, a phosphor film 61, a metal back (anode electrode) 62, a lateral wall 63, an electron-emitting device 64 shown in FIG. 1, a spacer 65, and a spacer fixing member 66. The lower wiring 5 and the upper wiring 7 mutually cross across an insulation layer, which is omitted from the illustration for the purpose of simplicity.

Referring to FIG. 12, the electron source substrate 1, the face plate 60 and the lateral wall 63 constitute a vacuum envelope for maintaining the interior of the display panel in a vacuum state. As the interior of the vacuum envelope is maintained at vacuum of about $10^{-4}$ Pa, a spacer 65 is provided as an atmospheric pressure resistant member for preventing the envelope from destruction by an atmospheric pressure or by an accidental impact, and the spacer 65 is fixed by a fixing member 66 provided outside an image display area.

The electron source substrate 1 is provided with electron-emitting devices 64 by a number n×m (n and m being positive integers equal to or larger than 2 and suitably selected according to a desired number of pixels). These devices are arranged in a simple matrix, by means of m upper wirings 7 and n lower wirings 5. Each crossing point between the upper wiring 7 and the lower wiring 5 is insulated by an unillustrated insulation layer.

The phosphor film 61 is divided into phosphors of three primary colors or red, green and blue, employed for example in the field of a cathode ray tube (CRT). The phosphor of each color is applied for example in a stripe shape or a dot shape. Between the phosphors of different colors, there is provided a black electroconductive member (black stripe or black matrix).

Also on an internal surface (opposed to the electron source substrate 1) of the phosphor film 61, a metal back 62, already known in the field of CRT, is provided as an anode electrode.

A producing method for the electron source substrate shown in FIGS. 11A and 11B will be explained with reference to FIGS. 4 to 9.

Figure 4:
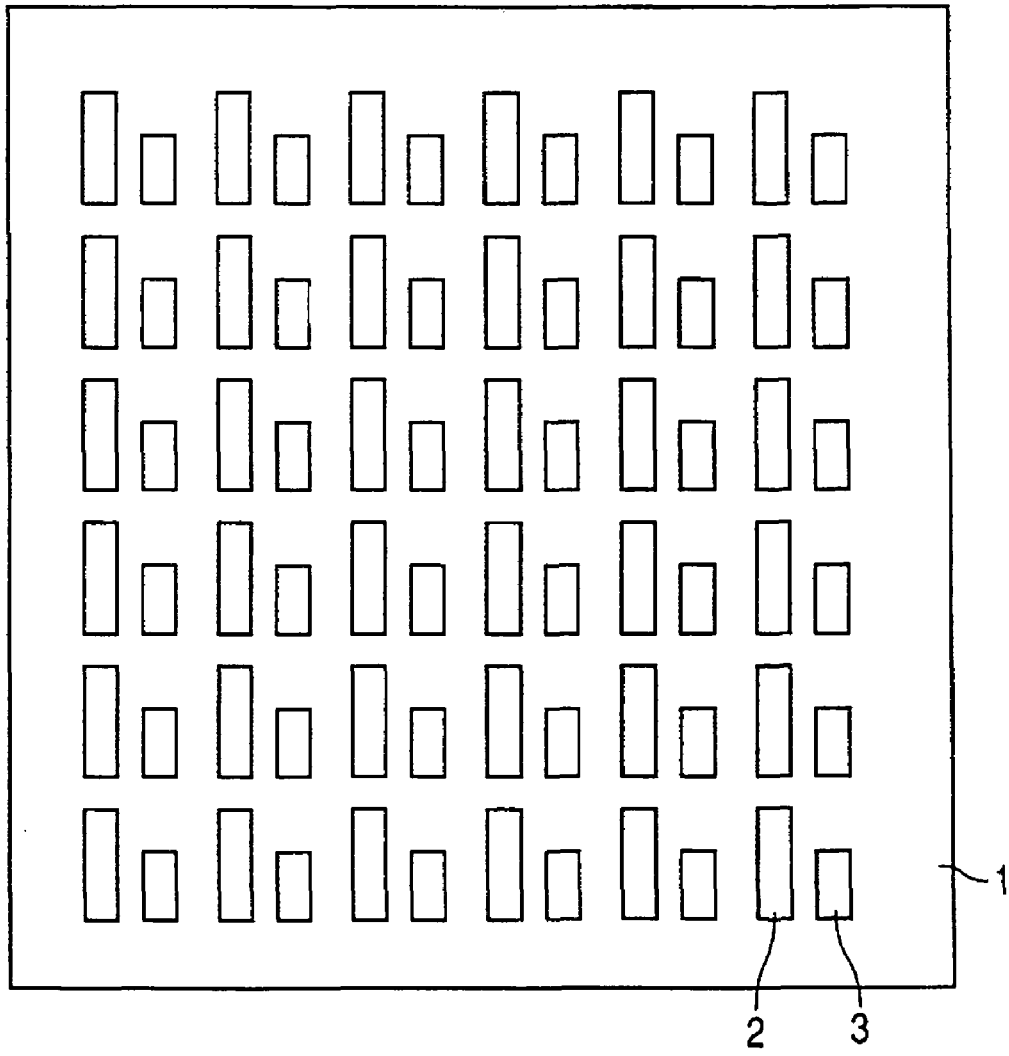
FIG. 4 is a schematic plan view showing a producing process of the electron source substrate of the present invention.
Figure 5:
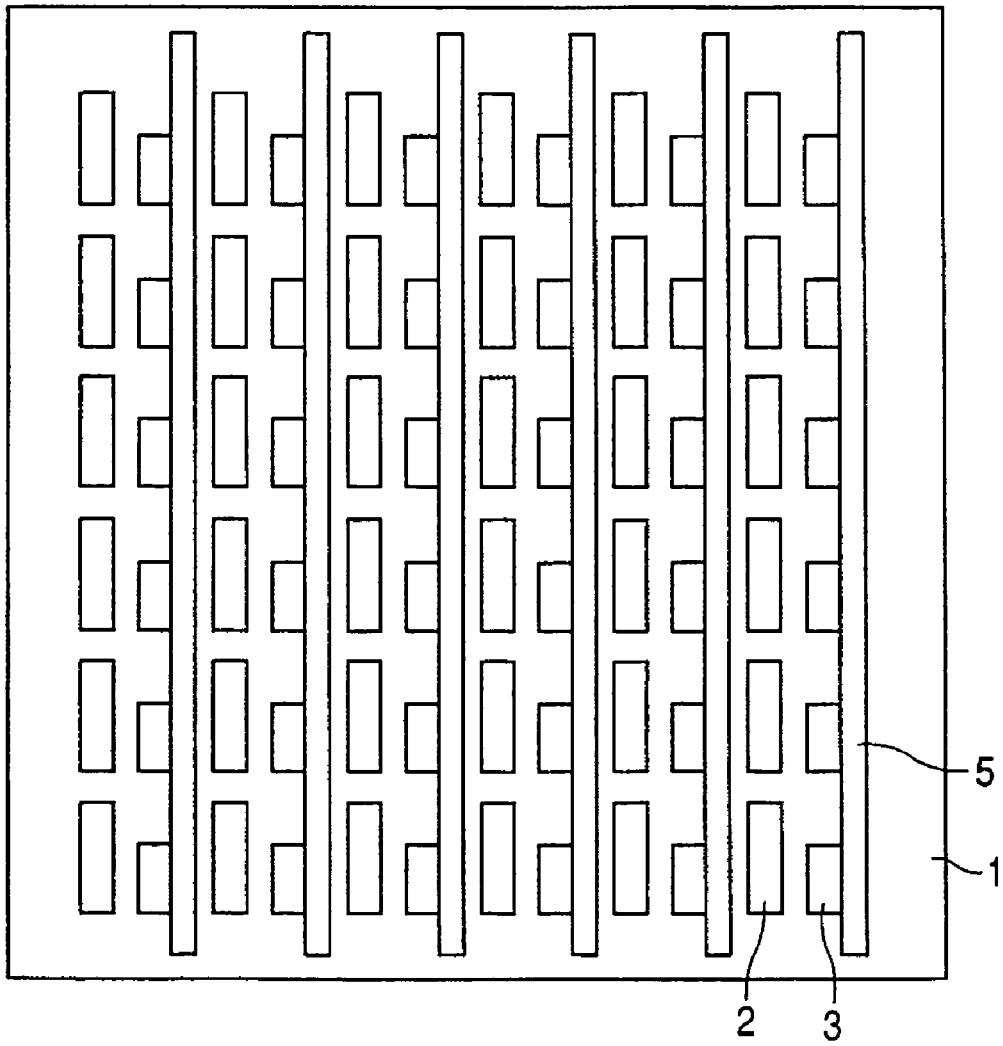
FIG. 5 is a schematic plan view showing a producing process of the electron source substrate of the present invention.
Figure 6:
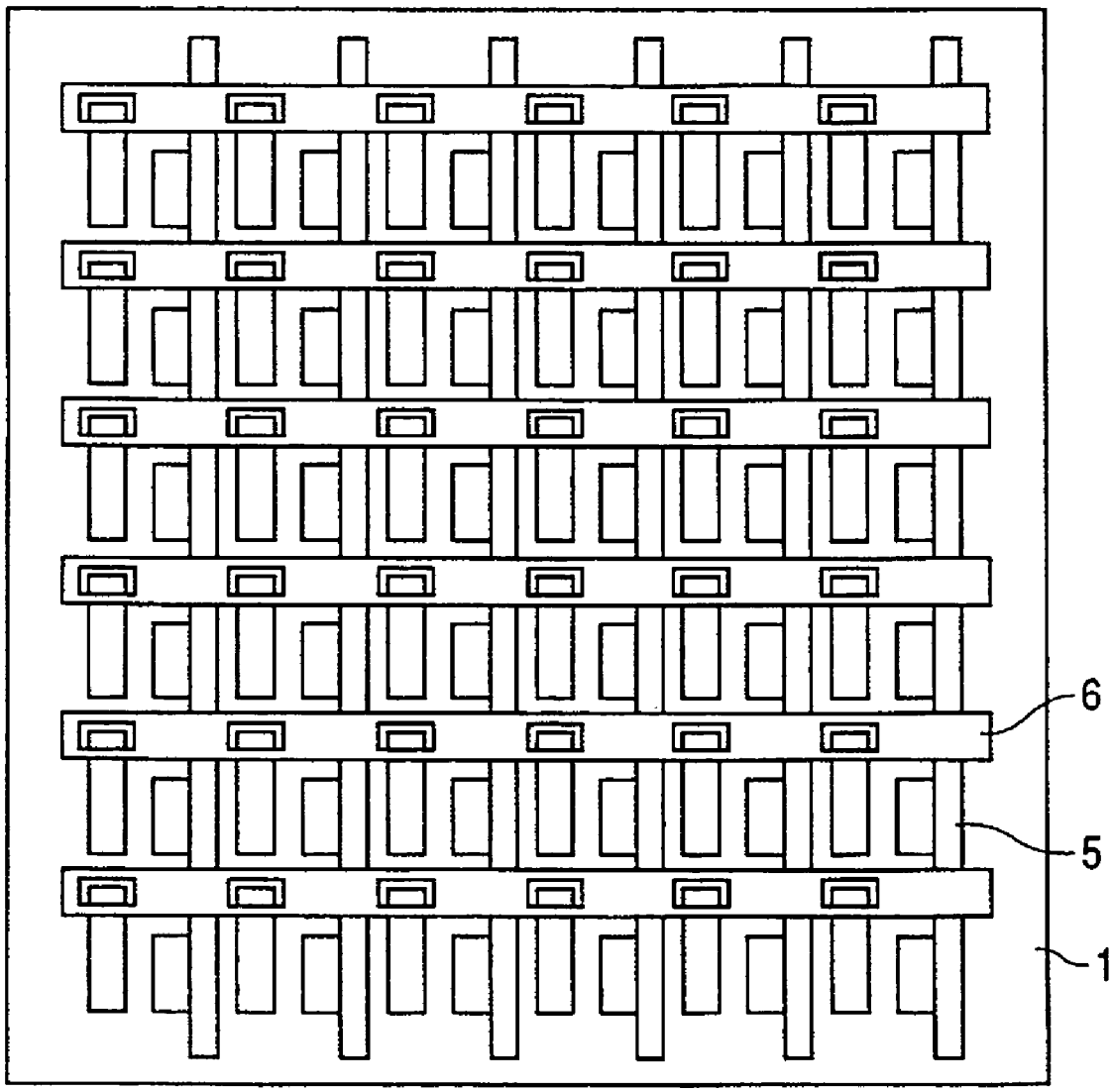
FIG. 6 is a schematic plan view showing a producing process of the electron source substrate of the present invention.
Figure 7:
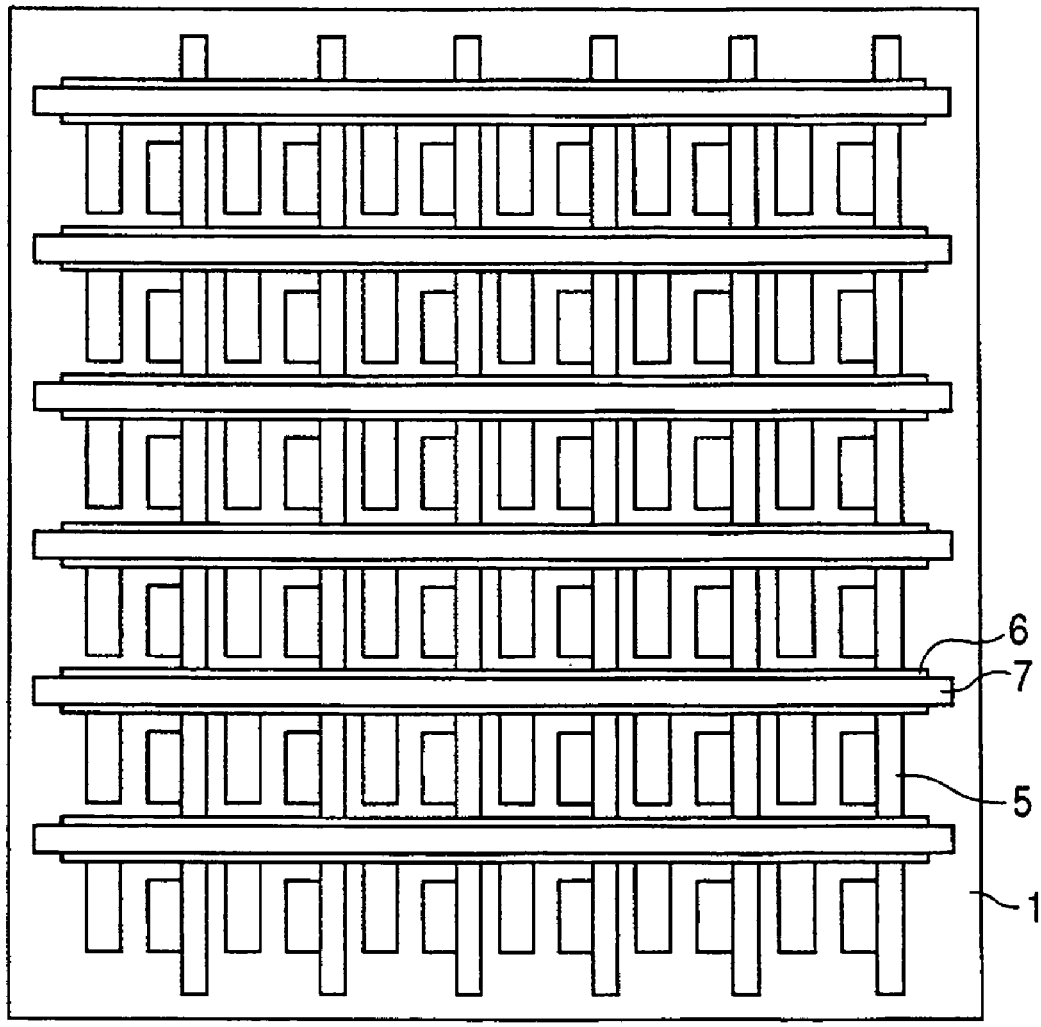
FIG. 7 is a schematic plan view showing a producing process of the electron source substrate of the present invention.
Figure 8:
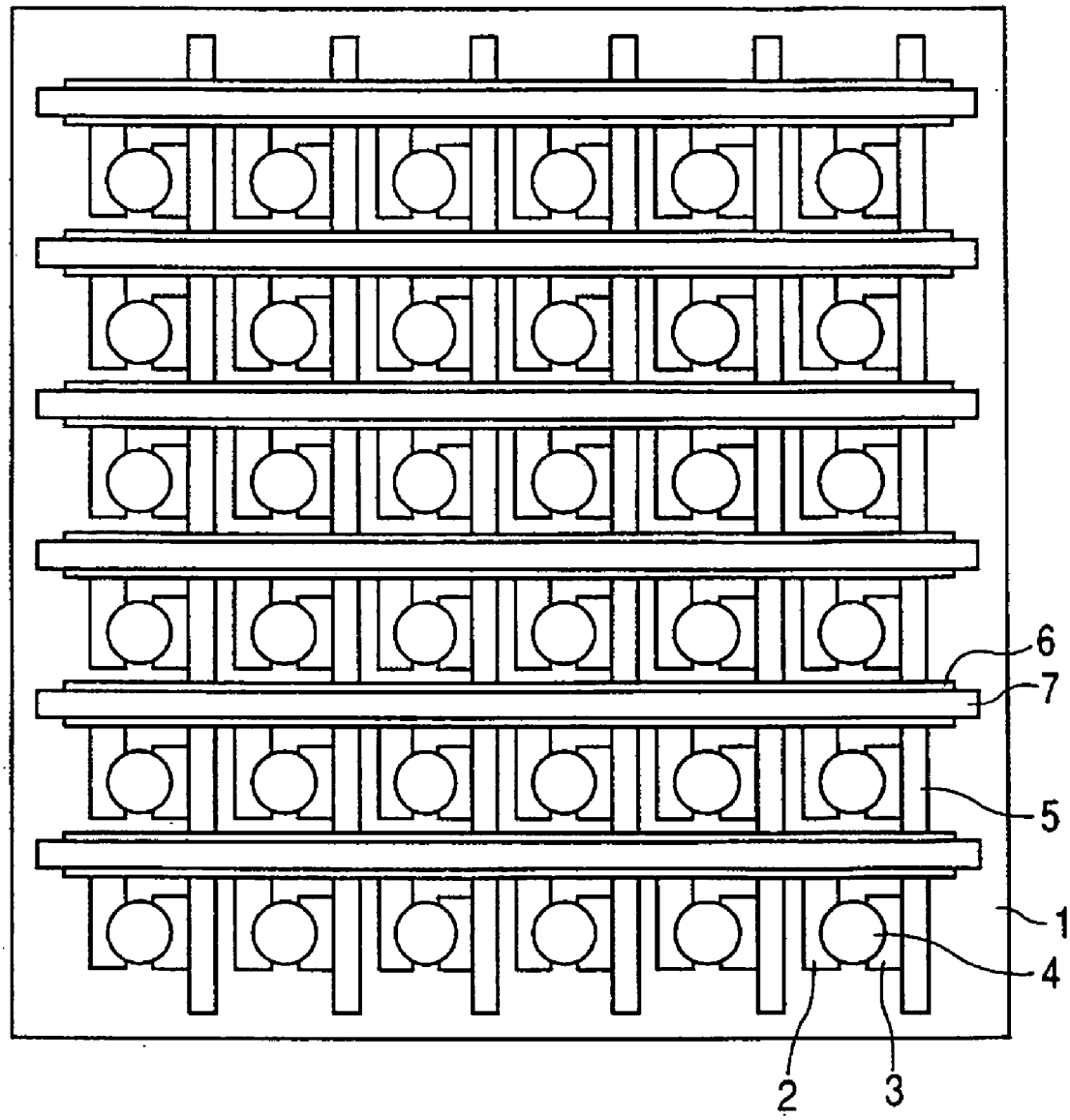
FIG. 8 is a schematic plan view showing a producing process for the electron source substrate of the present invention.
Figure 9:
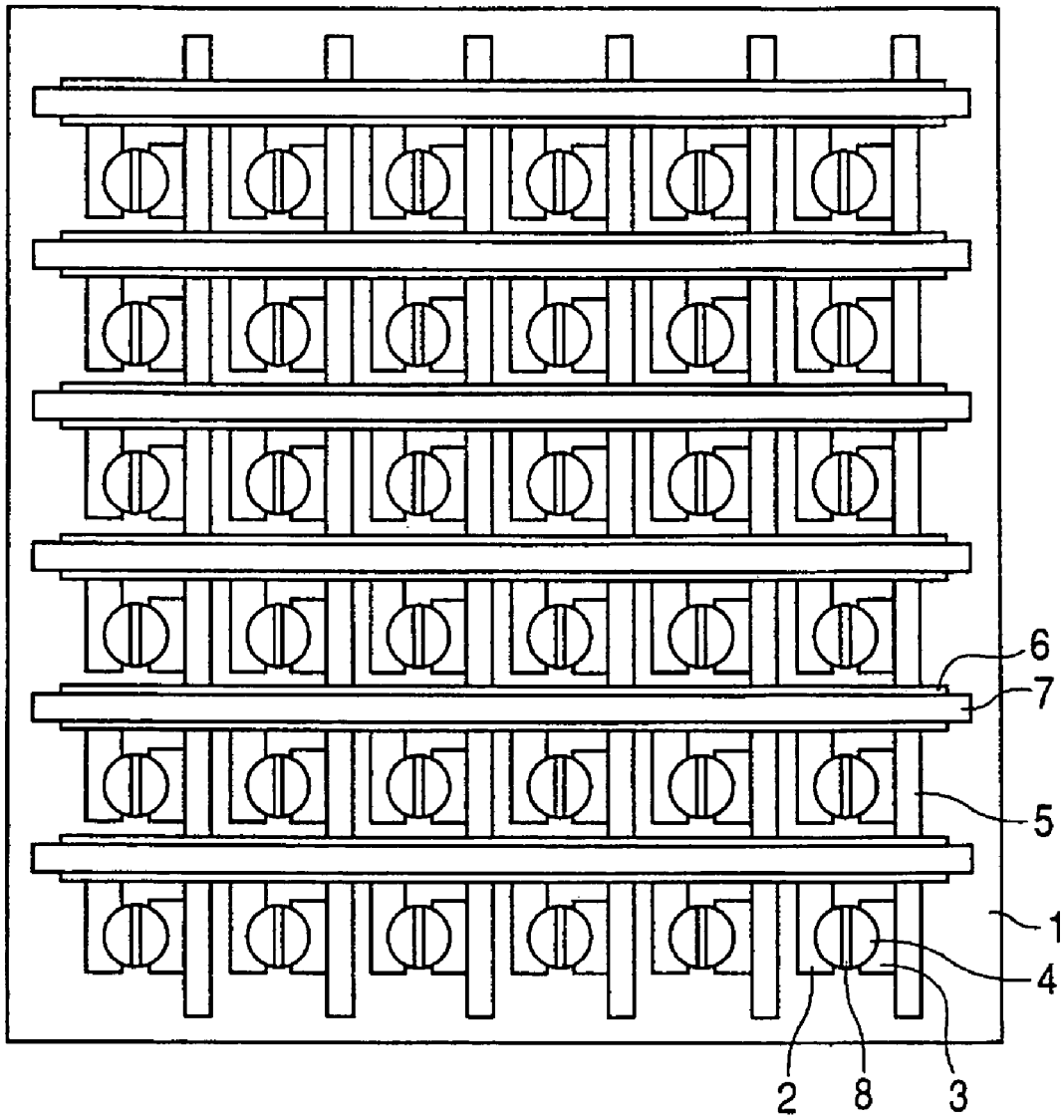
FIG. 9 is a schematic plan view showing an example of an electron source substrate prepared in the present invention.
Figure 10A:
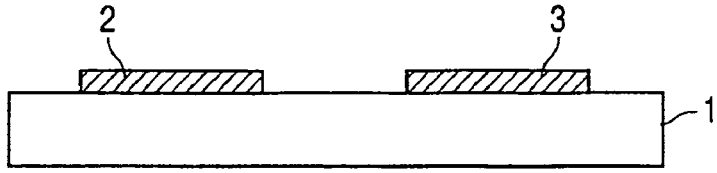
FIGS. 10A, 10B, 10C and 10D are schematic cross-sectional views showing a producing process for an electron emitting device utilizing an ink jet equipment in the present invention.
Figure 10B:
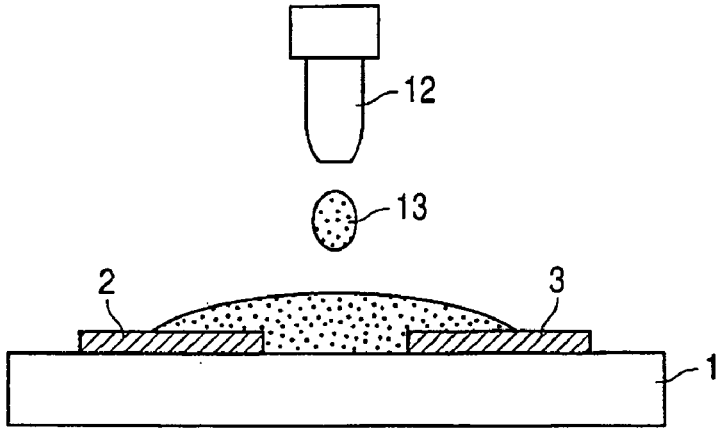
Figure 10C:
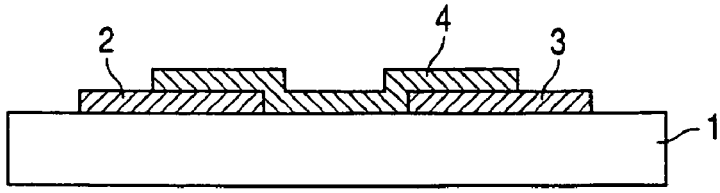
Figure 10D:
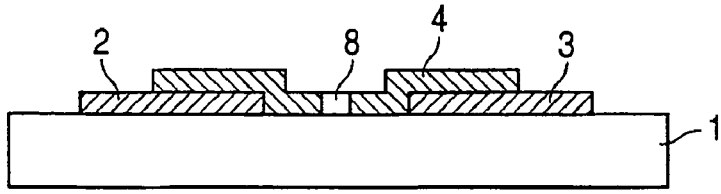

At first, on an insulating substrate 1, plural electrode pairs, each constituted of device electrodes 2, 3, are formed (FIG. 4). Then a lower wiring 5 is formed for commonly connecting device electrodes 3 arranged in a same column (FIG. 5), and an interlayer insulation layer 6 is formed (FIG. 6). In the interlayer insulation layer 6, a contact hole is formed for an electrical connection between the upper wiring 7 to be formed thereon and the device electrode 2. Then an upper wiring 7 is formed for commonly connecting device electrodes 2 arranged in a same row (FIG. 7). Thereafter, a solution containing a material of the electroconductive film 4 is applied by a film forming method of the present invention so as to connect the device electrodes 2, 3 in each electrode pair, and is sintered to form the electroconductive film 4 (FIG. 8). The obtained electroconductive film 4 is subjected to an energizing process to form an electron emitting area 8 (FIG. 9).

Figure 1:
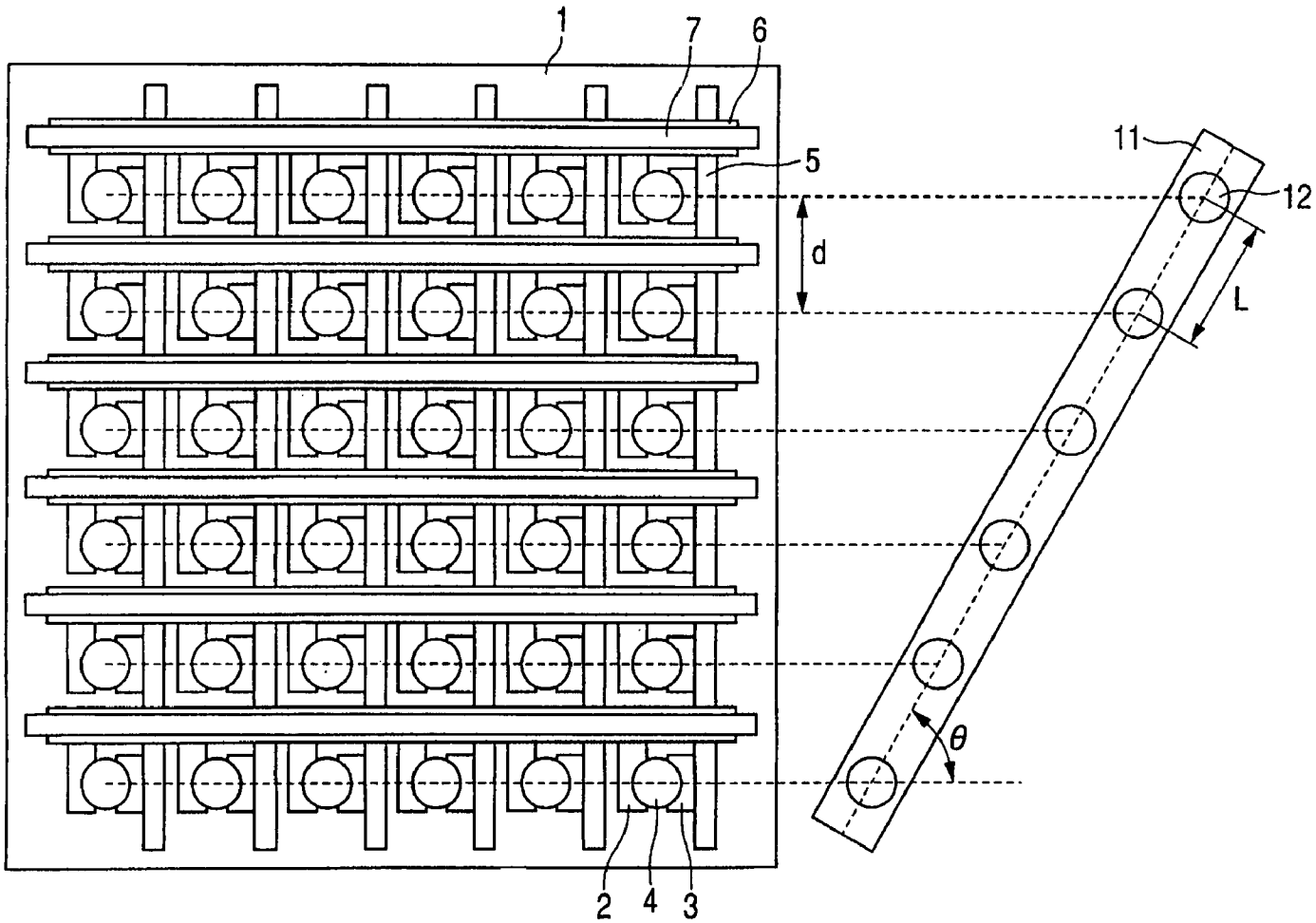
FIG. 1 is a schematic plan view showing a positional relationship between an ink jet head and a conductive film on an electron source substrate in the present invention.

FIG. 1 schematically shows a positional relationship between an ink jet head of the present invention and an electroconductive film 4 on the electron source substrate, formed by such ink jet head, wherein shown are an ink jet head 11 and a nozzle 12, and wherein members same as those in FIGS. 4 to 10 are represented by symbols same as those therein. These drawings illustrate, for the purpose of simplicity, an example of an electron source having electron-emitting devices in 6 rows and 6 columns and an ink jet head having six nozzles 12. However, the number of the electron-emitting devices is usually larger than the number of the nozzles in the ink jet head 11. Therefore the step of liquid drop application by a scanning motion of the ink jet head 11 parallel to the upper wiring 7 is executed plural times, with a displacement of the ink jet head 11 in a direction parallel to the lower wiring 5 in each step.

Figure 2:
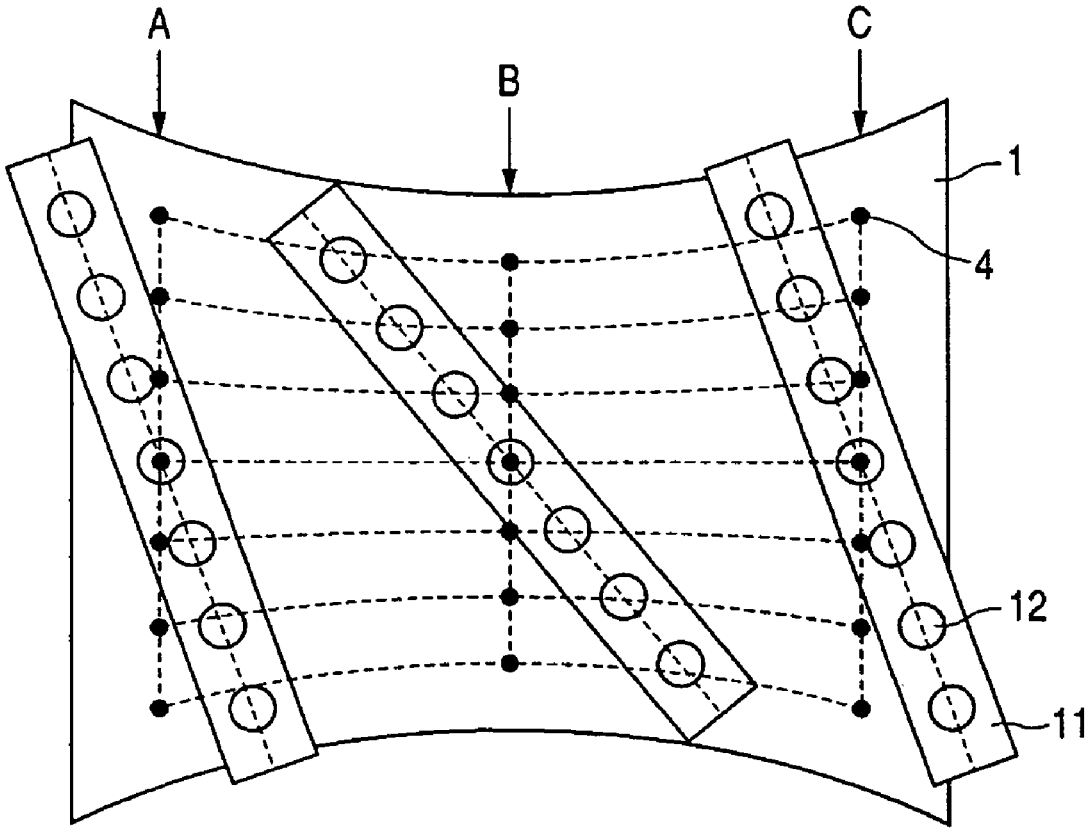
FIG. 2 is a schematic plan view showing a relationship between a distortion in the electron source substrate and an inclination of the ink jet head in the present invention.

As shown in FIG. 1, a pitch L of the nozzles 12 of the ink jet head 11 may not match a pitch d of the electroconductive films 4 on the electron source substrate. Therefore, the pitches are matched by inclining the ink jet head 11 by an angle:

$$\theta=\sin^{-1}(d/L)$$

with respect to the array of the devices. More specifically, the ink jet head is so inclined that the direction of arrangement of the nozzles forms an angle θ to the longitudinal direction of the array of devices or the upper wiring 7. However, in case the substrate 1 is distorted as shown in FIG. 2, the pitch of the electroconductive films 4, namely the pitch of the liquid droplet applying positions becomes different depending on the positions A-C within the substrate 1. In the present invention, therefore, the ink jet head 11 is rotated about a normal line to the substrate 1 in each position within the substrate to regulate an inclination to the array of the devices, whereby the liquid droplets are applied in a state where the pitch of the nozzles 12 coincides with the pitch of the electroconductive films 4. More specifically, the ink jet head 11 is so constructed that an angle thereof is arbitrarily variable. Also a distortion of the substrate in each position therein is measured in advance. Then ink jet head 11 is so rotated that the ink jet head 11 assumes an inclination angle:

$$\theta=\sin^{-1}(d_n/L)(n=1, 2, 3, \ldots)$$

corresponding to a pitch $d_n$ calculated in each position calculated from such measured value. Such rotating operation is executed simultaneous with the scanning motion of the ink jet head 11 parallel to the upper wiring 7. The scanning motion may be executed by the substrate 1, instead of the ink jet head 11. Such rotating operation need not be limited to an operation of continuously changing the angle. For example, the head may be inclined discontinuously in each of plural areas. Stated differently, the present invention is featured in that an inclination angle of the ink jet head at a liquid droplet application in a first area of the substrate is different from that of the ink jet head at a liquid droplet application in a second area of the substrate, depending on a device pitch in each area.

It is to be understood that the above rotating operation includes a pivot operation within a spirit and a scope of the present invention.

Figure 3:
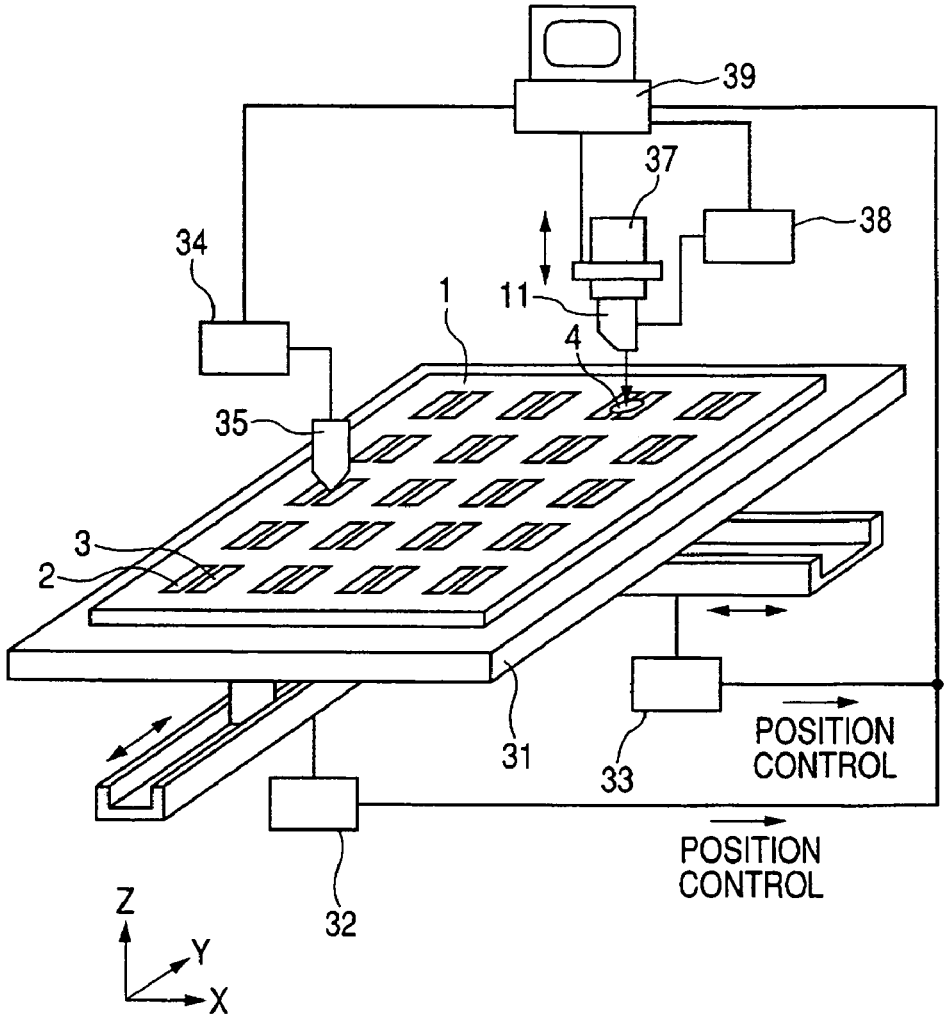
FIG. 3 is a schematic view showing a configuration of an ink jet head equipment utilizing a correction mechanism for a liquid droplet applying position employed preferably in the present invention.

FIG. 3 is a schematic view showing a constitution of an ink jet head equipment utilizing a correction mechanism for a liquid droplet applying position, preferably employed in the present invention. In FIG. 3, there are shown a stage 31 equipped with an X-Y scanning mechanism (not shown), stage scanning controllers 32, 33 which are position detecting mechanisms for detecting a stage position for example by a laser measurement, an image processing equipment 34, a CCD camera 35, a position correction controlling mechanism 37 for controlling a head alignment vernier mechanism, an ink jet control/drive mechanism 38, and a controlling computer 39.

In the structure shown in FIG. 3, the stage 31 is equipped with an X-Y scanning mechanism (not shown) for displacing the electron source substrate 1 in X and Y directions, on which the electron source substrate 1 (structures thereon being omitted except for device electrodes 2, 3 for the purpose of clarity) is placed. In a position above the electron source substrate 1 and capable of observing the substrate, there are provided a CCD camera 35 and also an ink jet head 11. In the illustrated structure, the ink jet head 11 is fixed to the equipment, while the electron source substrate 1 is moved to an arbitrary position by the stage 31, thereby realizing a relative displacement between the ink jet head 11 and the electron source substrate 1. A relationship between the position of the ink jet head 11 and a liquid droplet applying position to the substrate 1 is measured in advance. The optimum position can be detected by various methods, for example by fetching an image of the device electrodes 2, 3 with the CCD camera 35, then binarizing the image contrast and calculating a position of a center of gravity in thus binarized area of a specified contrast. In this operation, an enlargement, a reduction or an embedding of the image may be introduced at the binarization in order to improve the precision of the binarized image. The image processing equipment 34 may be any equipment capable of executing a desired image processing, and, for example, a general-purpose image processing equipment CS-902 manufactured by First Inc. can be employed advantageously.

Then image information (position of center of gravity) obtained by the image processing equipment 34 is compared with positional information obtained by the position detecting mechanism (stage scanning controllers 32, 33) for determining the position of the stage 31. Thus information is determined on the position of center of gravity of each device, present on the electron source substrate 1 placed on the stage 31, on the equipment. This information is supplied to the controlling computer 39.

The ink jet head 11 for applying liquid droplets onto the electron source substrate 1 is connected to the equipment across a head rotating mechanism (not shown), and the position of the head can be precisely displaced by the position correction controlling mechanism 37. The head rotating mechanism is constituted of a piezoelectric element and a mechanism for converting a displacement of the piezoelectric element into a rotational movement, and is capable of a precise rotation in a direction perpendicular to the ink jet head 11.

Also the ink jet head 11 is drive controlled by the ink jet head control/drive mechanism 38, thus being rendered capable of discharging a liquid droplet from each nozzle at an arbitrary timing. The ink jet head control/drive mechanism 38 is controlled by the controlling computer 39.

A discharging head unit to be employed in the ink jet head 11 may be of any equipment capable of forming an arbitrary liquid droplet. However, there is preferred an equipment of an ink jet method capable of capable of control within a range from about ten to several tens of nanograms and capable of easily forming a liquid droplet of a very small volume of several tens of nanograms or larger. Two representative ink jet methods are a method of generating a bubble in a solution utilizing thermal energy and discharging the solution based on such bubble generation (Bubble Jet (registered trade name) method), and a method of discharging a solution by kinetic energy (piezo jet method).

A material for the liquid droplet discharged from the ink jet head 11 for forming the electroconductive film 4 of the electron-emitting device is not particularly restricted as long as it is capable of forming a liquid droplet, and it may be a solution in which the aforementioned metal is dispersed or dissolved in water of a solvent, or a solution or a metalorganic compound. In case an element or a compound for forming the electroconductive film is based on palladium, there can be employed an aqueous solution containing an ethanolamine complex. Such ethanolamine complex can be, for example, a palladium acetate-ethanolamine complex (PA-ME), a palladium acetate-diethanolamine complex (PA-DE) or a palladium acetate-triethanolamine complex (PA-TE). There can also be employed a palladium acetate-butylethanolamine complex (PA-BE), or a palladium acetate-dimethylethanolamine complex (PA-DME). A droplet of such solution is applied by the ink jet head 11 in a desired position on the device electrodes 2, 3.

EXAMPLES

Example 1

An electron source substrate was prepared according to a process shown in FIGS. 4 to 9.

There was employed a substrate 1, prepared by coating and sintering an $SiO_2$ film of a thickness of 100 nm as a sodium blocking layer on a glass PD-200 (manufactured by Asahi Glass Co.) of a thickness of 2.8 mm. It was sufficiently washed with an organic solvent and dried at 120° C.

Then, on the substrate 1, a Ti film of a thickness of 5 nm as an undercoat layer and a Pt film of a thickness of 40 nm thereon were formed by a sputtering method. Then device electrodes 2, 3 were prepared by patterning these films by a lithographic process of coating, exposure and development of a photoresist followed by etching (FIG. 4). Then an Ag paste was screen printed on the substrate to form lower wirings 5 (FIG. 5). The device electrodes 2, 3 were prepared with a gap of 20 μm, an electrode width of 50 μm, a thickness of 50 nm and a pitch of 1 mm, and the lower wiring 5 was formed with a width of 300 μm and a thickness of 5 μm.

Then, for an insulation between the upper wiring and the lower wiring, an interlayer insulation layer 6 principally constituted of $SiO_2$ was formed by a screen printing (FIG. 6).

Then upper wirings 7 principally constituted of Ag were formed by a screen printing (FIG. 7).

The screen printing method employed for forming the wirings 5, 7 and the interlayer insulation layer 6 allowed to achieve a cost reduction, but the substrate 1 showed a distortion from a design value, because of a sintering process (400-500° C.) for the printed paste.

Then, on the substrate 1, a solution containing an organic palladium compound was applied by the ink jet equipment, in a liquid droplet of 60 $\mu m^3$ so as to extend between the device electrodes 2, 3. The solution of the organic palladium compound was prepared by dissolving a palladium-proline complex in a solvent formed by water and isopropyl alcohol (IPA) and by adding certain additives. For the liquid droplet application, a distortion amount of the substrate 1 was measured in advance by a measuring equipment, thereby determining an average pitch $d_n$ of the devices. The liquid droplet was applied in a desired position by controlling an inclination angle $\theta_n$ from time to time so as to satisfy a relation:

$$\theta_n = \sin^{-1}(d_n/L),\ n=1, 2, 3, \ldots$$

More specifically, during a displacement (scanning motion) of the stage 31 with respect to the ink jet head 11, the inclination angle θ of the ink jet head 11 is changed from time to time.

Thereafter a heating process is executed for 10 minutes at 300° C. to form an electroconductive film 4 constituted of fine particles of palladium oxide (PdO) (FIG. 8), and the electroconductive film 4 was subjected to an energizing process by applying a voltage between the device electrode 2, 3 thereby forming an electron-emitting area 8 (FIG. 9).

The electron source substrate thus obtained was used for preparing a display panel as shown in FIG. 12, and preparing an image forming equipment capable of a television display of NTSC system, thereby realizing an image display of a high image quality.

Example 2

A process same as in Example 1 was executed up to the preparation of the upper wirings 7. An aqueous solution containing a palladium acetate-ethanolamine complex by 0.2%, isopropyl alcohol by 15%, ethylene glycol by 1% and polyvinyl alcohol by 0.05% was prepared and liquid droplets of such aqueous solution were applied onto the substrate by an equipment as shown in FIG. 3.

In the present example, the liquid droplet applying step for the above-mentioned aqueous solution was conducted in the following manner:

[1] An image of individual device area on the substrate 1 was fetched by the CCD camera 35, and the image processing equipment 34 executed a process of extracting an image of the device electrodes 2, 3 from thus fetched image. In the present example, the image extraction was conducted by binarizing the fetched image;

[2] A liquid droplet applying position (measured value) was calculated by the controlling computer 39, based on the position of center of gravity of the liquid droplet applying pattern (pattern of the paired device electrodes 2, 3) obtained by the image processing, and the positional information of the stage 31 obtained by the position detecting mechanism. Also the controlling computer 39 prepared a correction table by comparing the measured value with the design value, and calculated an average pitch $d_n$ of the devices dependent on the position in the substrate 1.

In the present example, the average pitch $d_n$ of the devices was calculated by fetching an image with an interval corresponding to a number of devices same as the number of nozzles contained in the ink jet head 11 and by executing a calculation of the average pitch dn for such range of the devices. In case the distortion of the substrate 1 (aberration from the design value), caused for example by a heating process, is small, a tact time may be further reduced by taking a larger interval;

[3] Liquid droplets were applied in a scanning operation executed by synchronizing the stage 31 provided with the X-Y scanning mechanism and the ink jet control/drive mechanism 38. In this operation, the position-dependent average pitch $d_n$ obtained from the correction table is supplied to the position correction controlling mechanism 37 to drive the head rotating mechanism, thereby controlling the liquid droplet applying position and applying the liquid droplet in an optimum position on each device.

The liquid droplet was applied four times on each device, and was thereafter heated for 10 minutes at 350° C. to obtain an electroconductive film 4 of fine palladium oxide particles of a thickness of 10 nm. Then the electroconductive film 4 was subjected to an energizing process to obtain an electron-emitting area 8.

The electron source substrate thus obtained was used for preparing a display panel as shown in FIG. 12, and preparing an image forming equipment capable of a television display of NTSC system, thereby realizing an image display of a high image quality.

The present invention, in which a liquid droplet applying position is detected on a substrate and an ink jet head is rotated accordingly for applying liquid droplets in such manner that a pitch of the nozzles matches a pitch of the liquid droplet applying positions, allows to reduce an aberration in the liquid droplet applying position and improving a production yield in the film formation. Therefore the present invention can form the electroconductive film of the electron-emitting device efficiently and precisely, thereby producing the electron source substrate more inexpensively.

This application claims priority from Japanese Patent Application No. 2005-090663 filed Mar. 28, 2005, which is hereby incorporated by reference herein.

What is claimed is:

1. A film forming method for forming films in plural positions on a substrate by applying liquid including a film material locally to the plural liquid applying positions on the substrate from an ink jet head having plural nozzles arranged linearly at a desired interval, wherein the plural liquid applying positions are arranged in a matrix form and an average pitch of the plural liquid applying positions in one row is different from that in another row, the method comprising:

a step of detecting positional information of the plural liquid applying positions on the substrate;

a step of calculating an average pitch of the plural liquid applying positions in each row, based on the positional information detected in the detecting step;

a step of adjusting a rotation angle of the ink jet head so that a pitch of the nozzles in projection to a row direction substantially coincides with the average pitch of the plural liquid applying positions in each row, and a step of applying liquid to the liquid applying positions by scanning the ink jet head in a column direction in combination with rotating the ink jet head about an axis normal to the substrate by the rotation angle adjusted in the adjusting step.

2. A method for producing an electron source substrate which includes plural electron-emitting devices, each having a pair of device electrodes and an electroconductive film having an electron-emitting area and extending over the device electrodes, and in which the electron-emitting devices are matrix wired:

wherein the electroconductive film is formed by a film forming method according to claim 1.

3. A method for producing an image display apparatus comprising a substrate whereon a plurality of films are arranged, wherein said films are formed on the substrate by the forming method according to claim 1.

* * * * *